US005868173A

United States Patent [19]

Derudder et al.

[11] Patent Number: 5,868,173

[45] Date of Patent: Feb. 9, 1999

[54] LIFTER DEVICE FOR A JACQUARD MACHINE

[75] Inventors: Carlos Derudder, Heule; Dewispelaere André, Marke, both of Belgium

[73] Assignee: N.V. Michel Van de Wiele, Kortrijk-Marke, Belgium

[21] Appl. No.: 574,517

[22] Filed: Dec. 19, 1995

[30] Foreign Application Priority Data

Dec. 20, 1994 [BE] Belgium ..... 09401141

[51] Int. Cl.[6] ..... D03C 3/12; D03C 3/06

[52] U.S. Cl. ..... 139/65; 139/21; 254/396

[58] Field of Search ..... 139/59, 65, 21; 254/396, 400

[56] References Cited

U.S. PATENT DOCUMENTS

| | | | |
|---|---|---|---|
| 3,940,112 | 2/1976 | Lea | 254/400 |
| 4,858,654 | 8/1989 | Derudder | 139/59 |
| 5,038,837 | 8/1991 | Palau et al. | 139/65 |
| 5,139,052 | 8/1992 | Derudder | 139/65 |
| 5,353,846 | 10/1994 | Gheysen et al. | 139/65 |

FOREIGN PATENT DOCUMENTS

| | | |
|---|---|---|
| 529019 | 6/1954 | Belgium . |
| 280132 | 8/1988 | Belgium . |
| 459582 | 12/1991 | Belgium . |
| 570947 | 11/1993 | Belgium . |
| 627511 | 12/1994 | Belgium . |
| 75506 | 5/1958 | France . |
| 399930 | 11/1990 | France . |
| 2648159 | 12/1990 | France . |

*Primary Examiner*—Andy Falik
*Attorney, Agent, or Firm*—James Creighton Wray

[57] ABSTRACT

A lifter device for a jacquard machine comprising a first lifter element and a second lifter element suspended from at least one hook, respectively. The hook is adapted to be selected to be carried along by one of two knives moving up and down in counterphase. A reversing roller is provided on the device. A lifter cord is provided. The lifter cord is either attached at one end to a part of the machine and is then passed over a roller of the first lifter element or is attached directly to the first lifter element. In either case the cord is passed over a reversing roller and a roller of the second lifter element. The other end of the cord is connected to at least one harness cord. The reversing roller is hingedly fixed and is disposed with its working face diagonal to the working faces of the rollers of the lifter elements.

9 Claims, 4 Drawing Sheets

LIFTER DEVICE FOR A JACQUARD MACHINE

BACKGROUND OF THE INVENTION

The present invention relates to a lifter device for a jacquard machine, comprising a first and a second lifter element, suspended from at least one hook respectively, which hook can be selected to be carried along by one of two knives going up and down in counterphase; a reversing roller; and a lifter cord which:

a) either is attached by one end to a part of the device, and is passed in succession over a roller of the first lifter element, the reversing roller and a roller of the second lifter element;

b) or is attached by one end to the first lifter element, and is passed in succession over the reversing roller and a roller of the second lifter element;

and is connected by the other end to at least one harness cord for lifting at least one warp thread.

Such a lifter device according to the first alternative a) is known, as emerges from the description and the drawings of European Patent No. 0,399,930. In the case of this known lifter device the reversing roller is fixed on a fixed shaft on the weaving loom.

This lifter device is also designed with two hooks per lifter element, and one hook can be selected to be carried along by one knife, while the other hook can be selected to be carried along by the other knife. Each lifter element comprises a top and a bottom lifter roller. The two hooks interacting with a lifter element are connected to each other by a cord which is passed under the top lifter roller of said lifter element, while another lifter cord is passed over the bottom lifter roller of the first lifter element, the reversing roller and the bottom lifter roller of the second lifter element.

Each lifter element is thus suspended with the top lifter roller in the downward hanging loop of a cord which connects two interacting hooks. The two hooks interacting with a lifter element are known as complementary hooks.

Such a lifter device is provided for interaction with a jacquard machine on a weaving loom, on which a fabric is manufactured from weft threads and warp threads by in each case forming a shed between the warp threads and inserting at least one weft thread in said shed. During the formation of each shed the position of each warp thread relative to the weft thread or weft threads to be inserted is determined as a function of the desired weave between weft threads and warp threads. The jacquard machine is controlled to take the warp threads into the desired position for each shot (i.e. the insertion of one or more weft threads).

Each hook optionally either can not be selected, so that it is not carried upwards by a knife, and thus remains in its lowest position, or can be selected, so that it is carried along by a knife and makes an up and down movement. The selection of the hooks is carried out by generally known means.

By selecting or not selecting the respective hooks which interact with a first and a second lifter element, the warp threads can be optionally taken to one of three possible heights.

In the case of this known lifter device the lifter elements are disposed in such a way that the working faces of the lifter element rollers run at right angles to the lengthwise direction of the knives, so that the complementary hooks of each lifter element are situated behind one another.

In a first embodiment the lifter elements are situated behind one another, so that the four hooks of the lifter device are situated behind one another. In the case of this embodiment each hook of the lifter device consequently has to interact with a different knife, so that the jacquard machine has to be provided with four knives per row of adjacent lifter devices. The reversing roller is disposed with its working face in the plane in which the working faces of the lifter element rollers are situated.

In a second embodiment the lifter elements are situated adjacent to each other, so that the corresponding hooks of the two lifter elements are situated adjacent to each other, and can thus interact with the same knife. In this embodiment only two knives are consequently necessary per row of adjacent lifter devices. The reversing roller is disposed with its working face running in the lengthwise direction of the knives (at right angles to the working faces of the lifter element rollers).

In this embodiment the distance (in the lengthwise direction of the knives) between the first and the second lifter elements (and also between their complementary sets of hooks) is at least virtually equal to the diameter of the reversing roller.

The diameter of the reversing roller determines the radius of curvature of the lifter cord bent over it and consequently has an effect on the wear, and thus also on the service life of said lifter cord, namely the smaller this diameter the greater the wear on the lifting cord.

This known lifter device has the disadvantage that the distance between the first and second lifter elements must be relatively great if a reversing roller with a sufficiently large diameter to obtain acceptable wear of the lifter cord is provided.

If these lifter devices are provided on a jacquard machine whose hooks are disposed adjacent to each other at relatively small intervals, two adjacent complementary hooks cannot be used for the first and second lifter element. Between the sets of hooks interacting with a first and a second lifter element there is always one set of hooks which cannot be used. (This is shown in FIG. 4 of EP-0,399,930).

A lifter device having the characteristics described in the first paragraph of this description, and according to the second alternative b), is known from Belgian Patent Application No. 529,019.

This known lifter device comprises a first and a second lifter element, which elements, as described above, interact with respective complementary hooks. A lifter cord is attached by one end to the first lifter element and is passed in succession over a reversing roller and the bottom lifter roller of the second lifter element, while the other end is connected to a harness cord.

There are four possible positions for the warp threads: when both lifter elements are hanging in their lowest position, when only the first lifter element is hanging in its top position, when only the second lifter element is hanging in its top position, and when both lifter elements are hanging in their top position.

The top and bottom position of each lifter element is obtained by selecting or not selecting in the known manner the respective hooks interacting with the lifter element.

In the case of this known lifter device the reversing roller is connected by means of a cord to a board below. The lifter elements are situated after one another with the working faces of their lifter element rollers at right angles to the lengthwise direction of the knives. The reversing roller is disposed with its working face in the plane in which the working faces of the lifter element rollers are situated. In the case of this lifter device the four hooks are situated behind one another, so that the jacquard machine must be provided with four knives for each row of adjacent lifter devices.

SUMMARY OF THE INVENTION

The object of this invention is to provide lifter devices according to the two alternatives (a, b) which were described in the first paragraph of this description, in which the first and the second lifter element can be situated next to each other, so that their corresponding hooks can interact with the same knife, and in which the distance between said lifter elements can be much smaller than in the case of the known lifter devices, while a reversing roller with a diameter which is sufficiently large to obtain acceptable wear of the lifter cord can still be provided.

This object is achieved by disposing the reversing roller with its working face diagonal relative to the working faces of the lifter element rollers.

This means that the distance (in the lengthwise direction of the knives) between the adjacent lifter elements can be much smaller than the diameter of the reversing roller. Even when the distance between the lifter elements is relatively small, the diameter of the reversing roller can still be large enough to obtain acceptable wear of the lifter cord.

As a result of this, two adjacent sets of complementary hooks can be used in each case for the first and second lifter elements on jacquard machines in which the hooks are disposed next to each other at relatively small intervals.

It is known to achieve a progressive shed formation on a jacquard machine by disposing the part on which the reversing rollers are fixed (preferably a grate) at a certain inclination (in a direction at right angles to the lengthwise direction of the knives).

In the case of the known lifter device, according to the second embodiment, described in EP-0,399,930 the shafts of the reversing rollers are consequently given the same inclination, while the lifter cords extend vertically upwards from each reversing roller. This produces bending stresses in the shafts of the reversing rollers, greater wear of the lifter cord, and an adverse load on the part on which the reversing rollers are fixed.

Where a grate with grate bars on which the reversing rollers are immovably fixed at one side is used, bending in the fixing shaft and inadmissible torsion in the grate bar bearing the fixing shaft are obtained.

In the case of the operation of a jacquard machine with a lifter device according to Belgian Patent Application No. 529,019 the reversing roller (which is connected by means of a cord to a board below) not only oscillates back and forth, but also rotates about the axis of the cord, which is known as rotational oscillations.

On the one hand, it gives rise to increased wear of the lifter cord and, on the other hand, it is often the cause of the various adjacent parts of the lifter cord becoming entangled.

An additional object of this invention is to overcome the abovementioned disadvantages.

This object is achieved by according to this invention fixing the reversing roller hingedly on a part of the device.

If the part on which the reversing roller is fixed is inclined in a direction at right angles to the knives, the reversing roller, by rotating relative to said part, can assume a position in which the inclination of its axis is minimal. The abovementioned adverse loads are consequently reduced considerably, and the lifter cord is subject to much less wear. Due to the fact that the reversing roller can move only in the direction determined by the hinge, the rotational oscillations are significantly reduced. As a result of this, the entanglement of parts of the lifter cord is avoided and wear on the lifter cord is considerably reduced.

In a preferred embodiment according to this invention the reversing roller is hinged about an axis extending virtually horizontally. This means that the reversing roller is rotatable only in a plane at right angles to the direction of the knives. If the part on which the reversing roller is fixed is inclined in a direction at right angles to the knives, the reversing roller, by rotating relative to said part, can assume a position in which its axis extends horizontally. The working face of the reversing roller is consequently vertical, which is ideal, since the lifter cords also extend vertically. The abovementioned disadvantages are consequently avoided in a particularly advantageous manner.

Moreover, any rotation relative to a vertical axis is out of the question, so that no rotational oscillations can occur.

All this also guarantees a longer service life of the lifter cord.

The reversing roller is preferably fixed on a short, rigid stem.

If the shaft of the reversing roller is fixed at both ends, this ensures that it is not subject to great bending as a result of the pulling force exerted by the lifter cord. The bending in any case is less than is the case with fixing at one side. In the case of the lifter device according to EP-0,399,930, where the shaft of the reversing roller is fixed at one side, it was in fact found that the shaft can be bent by this pulling force. The roller consequently goes into an oblique position, and the lifter cord jumps out of the roller groove relatively easily.

In a special embodiment of the lifter device according to this invention the reversing roller is fixed on a first grate, and/or one end of the lifter cord is attached to a second grate, while said grates can be provided in such a way that they are set in motion up and down in phase with one of the knives.

With such a jacquard machine, through suitable control of the grates, the warp threads can be raised to four or five different heights. If both grates are immovably fixed, three different heights can be achieved.

Another special embodiment of the lifter device according to this invention is designed in such a way that each lifter element interacts with two hooks which can be carried along by a different knife and are connected to each other by a cord, while each lifter element comprises a top and a bottom lifter roller, and the cord is passed under the top lifter roller, while the lifter cord is passed over the bottom lifter roller.

In another special embodiment of the lifter device according to this invention, each lifter element is suspended from one hook, which can be selected for retention at one of two different heights.

In yet another special embodiment of the lifter device according to this invention, the first lifter element is omitted, while one end of the lifter cord is attached to a first hook and is passed in succession over the reversing roller and a roller of the second lifter element, while the second lifter element is suspended from a second hook, and the first and the second hook can be selected for retention at one of two different heights.

This invention is further illustrated in the detailed description which follows of a possible embodiment of a lifter device for a jacquard machine, according to this invention.

DESCRIPTION OF THE DRAWINGS

In this description reference is made to the appended figures, in which.

DETAILED DESCRIPTION OF THE PREFERRED EMBODIMENTS

Figure 1:
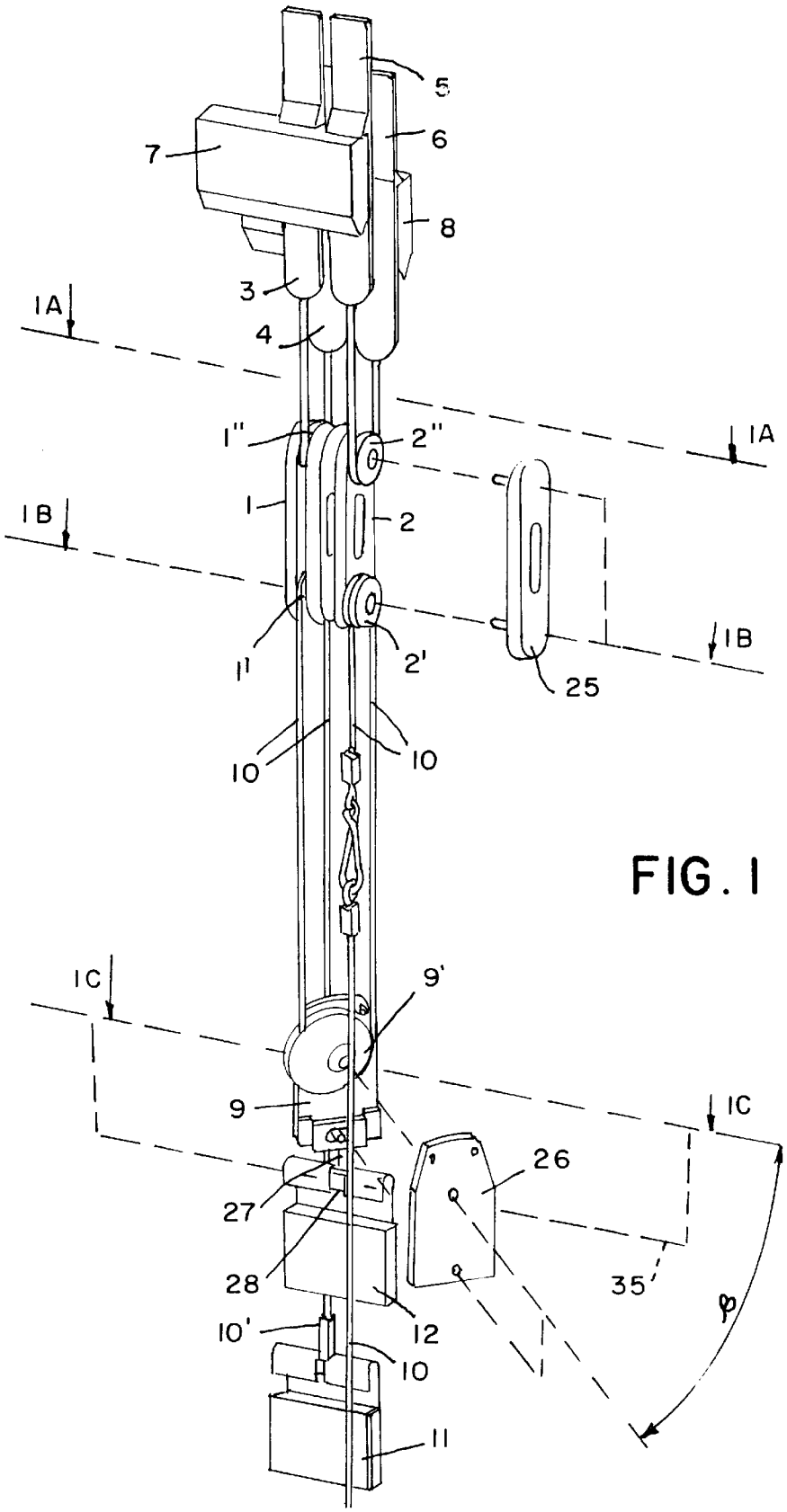
FIG. 1 shows in perspective a lifter device of an electronic jacquard machine.
Figure 1A:
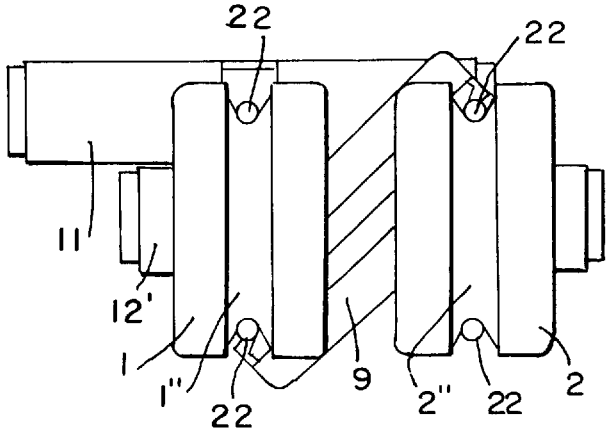
FIGS. 1A, 1B and 1C show cross-sections of the lifter device of FIG. 1, along the axes AA, BB and CC respectively.
Figure 1B:
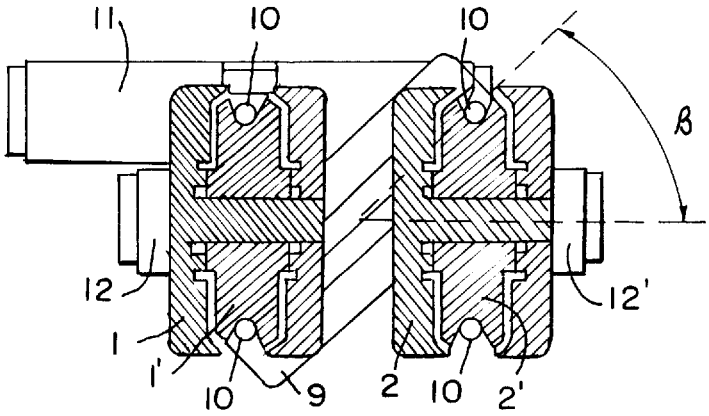
Figure 1C:
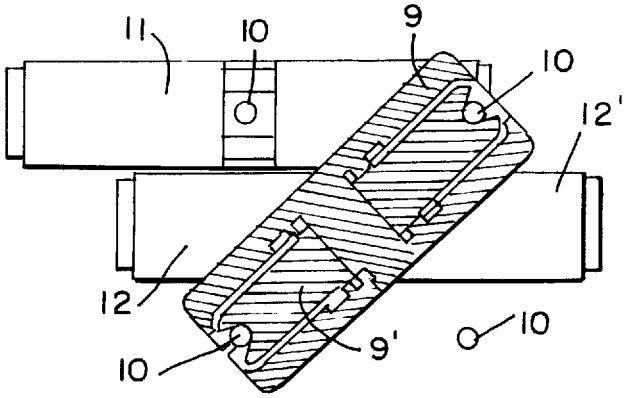

A lifter device of an electronic jacquard machine according to this invention (see FIGS. 1, 1A, 1B, 1C) comprises a first lifter element (1) and a second lifter element (2), provided respectively with a top lifter roller (1"), (2") and a bottom lifter roller (1'), (2'). The lifter rollers (1', 1"), (2', 2") of each lifter element (1), (2) are disposed rotatably between flank plates (25). In FIG. 1 a flank plate (25) of the second lifter element (2) has been taken away.

The lifter elements (1), (2) can also be designed in such a way that the bottom lifter roller (1'), (2') is situated in a plane which forms an angle with the plane in which the top lifter roller (1"), (2") is situated.

Each lifter element (1), (2) is suspended with the top lifter roller (1"), (2") in the downward hanging loop of a cord (22) which connects two complementary hooks (3, 4), (5, 6).

Each hook (3, 4), (5, 6) can be selected by known selection means (not shown in the figures) to be carried along by a knife (7), (8) making an up and down movement. One hook (3), (5) of two complementary hooks (3, 4), (5, 6) can be carried along by one knife (7), while the other hook (4), (6) can be carried along by the other knife (8).

The two knifes (7), (8) are connected to drive means (not shown in the figures), with the result that they can be set in motion up and down in counterphase with each other.

A hook (3, 4), (5, 6) which has not been selected is not carried along by a knife and remains supported in its lowest position by known means which are not shown in the figures.

Only a short part of each of the knives (7), (8) is shown in the figures. Each knife (7), (8) forms part of a knife grate (not shown in the figures). Two knife grates, which can be set in motion up and down in counterphase with each other, are provided. Two knives (7), (8) belonging to a different knife grate interact with each lifter device. The knife grates consist essentially of a rectangular frame within which a series of knives (7), (8) extend parallel to two opposite sides.

Disposed below the lifter elements is a reversing roller which is provided with grate bars (12). Only a short part of one grate bar (12) in each case is shown in the figures. The grate itself (not shown in the figures) consists essentially of a rectangular frame within which a series of grate bars (12) extend parallel to two opposite sides. The grate bars (12) run parallel to the knives (7), (8).

Fixed on a grate bar (12) extending below the lifter elements (1), (2) of a lifter device is a reversing roller element (9), essentially comprising two flank plates (26), between which a reversing roller (9') is rotatably fixed on a shaft which is fixed at both ends. One of the flank plates (26) has been detached from the reversing roller element (9) in FIG. 1.

One of the flank plates is fixed on a short, rigid stem (27), which in turn is hingedly fixed on the grate bar (12). For this purpose, the grate bar (12) is provided with an upward projecting wing (13). A pin (28) is rotatably retained, parallel to the grate bar (12), inside the space enclosed by said wing (13). The wing (13) is provided with a slit extending at right angles to the grate bar (12). The stem (27) is connected to the pin (28), and extends upwards from the pin (28) by means of the slit.

Due to the fact that the pin (28) can rotate about an axis (35) extending parallel to the grate bar (12), while the stem (27) in this case has to follow the slit, the reversing roller element (9) is rotatable relative to the grate bar (12) in a direction at right angles to the grate bar (12).

Any rotation of the reversing roller element in another direction is out of the question; Nor can the reversing roller element (9) rotate about an axis extending in the direction of the stem (27). The angle (β) between the direction of the axis of the reversing roller (9') and a direction parallel to the grate bar (12) is thus unalterable.

Disposed below the reversing roller grate is a lifter cord attachment grate. Only a short part of one grate bar (11) of said lifter cord attachment grate (11) in each case is shown in the figures. The grate itself (not shown in the figures) also consists essentially of a rectangular frame, inside which a series of grate bars (11) extend, parallel to two opposite sides and to the knives (7), (8).

One end (10') of a lifter cord (10) is attached to a grate bar (11) extending below the lifter elements (1), (2) of a lifter device.

The lifter cord (10) extends upwards from said end (10'), is passed over the bottom lifter roller (1') of the first lifter element (1), then runs downwards, where it is passed under the reversing roller (9'), runs back upwards, where it is passed over the bottom lifter roller (2') of the second lifter element (2), and runs back down, where the other end is connected to one or more harness cords (not shown in the figures) for lifting at least one warp thread.

A series of adjacent lifter devices can interact with two knives (7), (8) of a different knife grate, a knife bar (12) of the reversing roller grate and a knife bar (11) of the lifter cord attachment grate.

The same jacquard machine can also be provided with several series of adjacent lifter devices. For each series a grate bar (12) is then, of course, provided on the reversing roller grate, a grate bar (11) on the lifter cord attachment grate, and a knife on each knife grate.

In another embodiment of the lifter device according to this invention the lifter cord attachment grate is not provided, and the end (10') of the lifter cord (10) is attached to the first lifter element (1).

The reversing roller element (9) is disposed in such a way on the stem (27) that the axis of the reversing roller (9') forms an angle (β) with the lengthwise direction of the grate bar (12) of the reversing roller grate. The working face of the reversing roller (9') in this case is situated diagonally relative to the working faces of the lifter element rollers (1', 1"), (2', 2"). This can be seen most clearly in FIGS. 1A and 1B.

Figure 2:
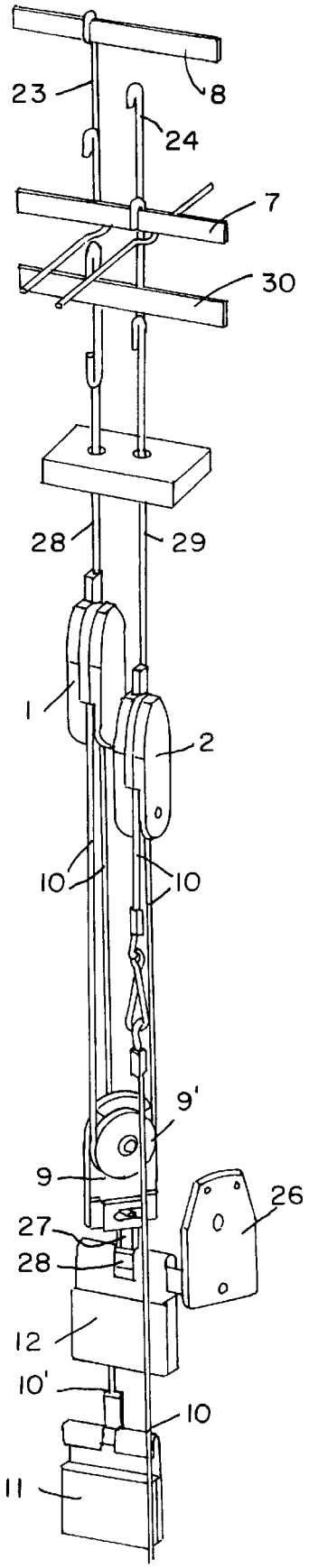
FIG. 2 shows in perspective a lifter device of a mechanical jacquard machine, in which each lifter element is suspended from one hook.
Figure 3:
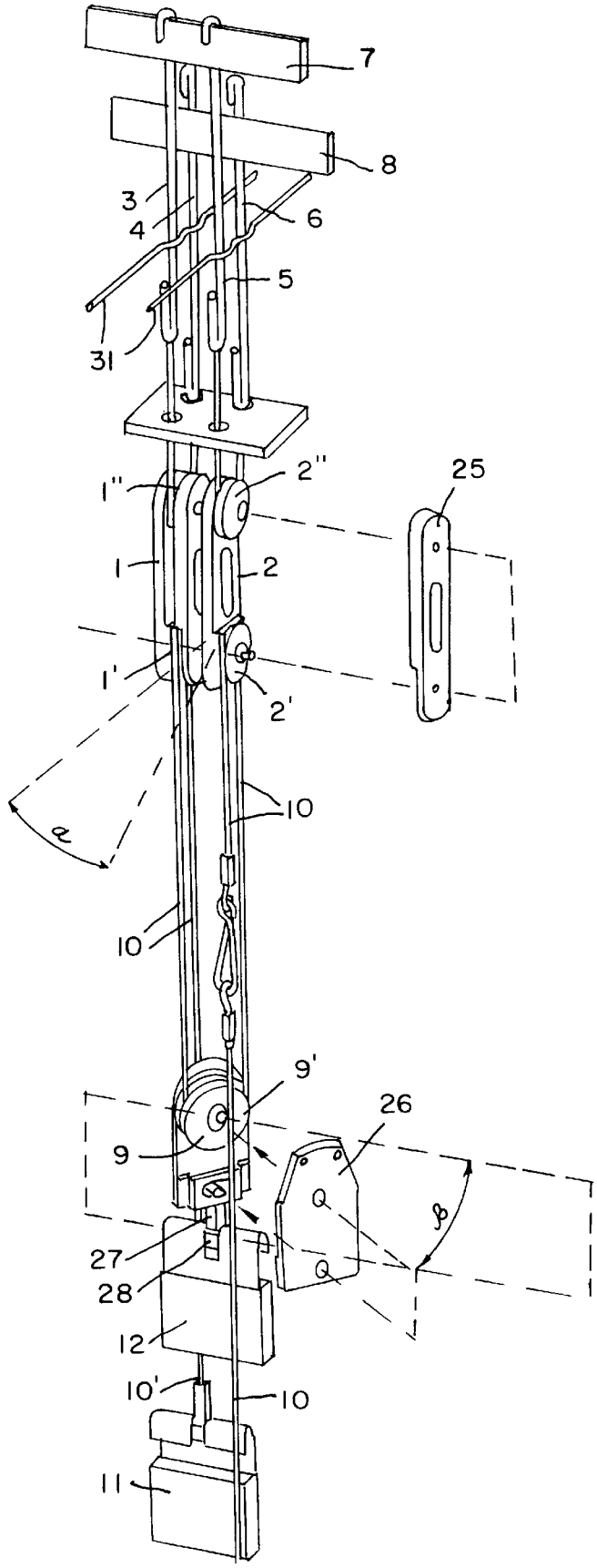
FIG. 3 shows in perspective a lifter device of a mechanical jacquard machine, in which each lifter element is suspended from two complementary hooks.

A lifter device of a mechanical jacquard machine, in which each lifter element (1), (2) interacts with one hook (23), (24) differs from the lifter device described above (see FIG. 2) only through the fact that each lifter element (1), (2) has only one lifter roller (over which the lifter cord (10) is passed), and through the fact that each lifter element (1), (2) is suspended by means of a cord (28), (29) from one hook (23), (24). Through the use of known selection means, each hook (23), (24) optionally either can remain in its lowest position, or can be set in motion up and down by a knife (7), (8), or can remain in its highest position. A hook (23), (24) remains in its highest or lowest position through the fact that it is hooked on a grate bar (30) of a locking grate at a height corresponding to that position.

In another embodiment of a lifter device for a mechanical jacquard machine, in which each lifter element (1), (2) interacts with one hook (23), (24), the lifter cord attachment grate is not provided, and the end (10') of the lifter cord (10) is attached to the first lifter element (1). In this arrangement the first lifter element (1) is therefore preferably omitted, and the end (10') of the lifter cord (10) is attached directly to a hook (23).

In a preferred embodiment according to this invention the reversing roller grate and/or the lifter cord attachment grate are provided so that they are set in motion up and down in phase with one of the knife grates. This means that the number of positions which the warp threads can be given with a lifter device according to this invention can be increased from three to four or five.

In another preferred embodiment the jacquard machine is provided with means for optionally either disposing the reversing roller grate, and possibly also the lifter cord attachment grate, in a fixed position or in such a way that they can be set in motion up and down in phase with one of the knives (7), (8). This means that the jacquard machine is easily and quickly converted to a three-position, a four-position or a five-position jacquard machine, depending on the fabric to be woven.

Through the hinged arrangement of the reversing roller element (9), rotational oscillations are prevented from occurring in a particularly efficient manner, while an inclination of the reversing roller grate is possible while retaining a central pull on reversing roller (9') towards the hinge point (28).

This prevents entanglement of lifter cord parts, and wear of the lifter cord, even when the reversing roller grate is inclined, is significantly reduced compared with the known lifter devices. The service life of the lifter cord is also increased further through the fact that, as a result of its diagonal arrangement, for a well-defined spacing, the reversing roller can have a larger diameter.

We claim:

1. Lifter device for a jacquard machine, comprising a first lifter element (1) and a second lifter element (2), wherein only one of each lifter element is suspended from at least one hook (3, 4), (5, 6) respectively, which hook can be selected to be carried along by one of two knives (7), (8) going up and down in counterphase; said lifter device further comprising a reversing roller (9') and a lifter cord (10), wherein said cord is attached by one end (10') to a part (11) of the device and is passed in succession over a bottom lifter roller (1') of the first lifter element (1), the reversing roller (9') and a bottom lifter roller (2') of the second lifter element (2); and the lifter cord is connected by another end to at least one harness cord for lifting at least one warp thread on a weaving loom, wherein the reversing roller (9') is disposed with a working face diagonally positioned between respective working faces of the lifter rollers (1'), (2').

2. Lifter device for a jacquard machine according to claim 1, characterized in that the reversing roller (9') is hingedly fixed on a part (12) of the device.

3. Lifter device for a jacquard machine according to claim 2, characterized in that the reversing roller (9') is hinged about a substantially horizontal axis (35).

4. Lifter device for a jacquard machine according to claim 1, including a short rigid stem hingedly connected to a grate means characterized in that the reversing roller (9') is fixed on the short rigid stem (27).

5. Lifter device for a jacquard machine according to claim 1, characterized in that a shaft of the reversing roller (9') is fixed at both ends on opposing flank plates.

6. Lifter device for a jacquard machine according to claim 1, characterized in that the reversing roller (9') is fixed on a first grate means (2).

7. Lifter device for a jacquard machine according to claim 6 wherein said part of the device comprises a grate means.

8. Lifter device for a jacquard machine according to claim 1, characterized in that each lifter element (1), (2) interacts with two hooks (3, 4), (5, 6) which are adapted to be carried along by a different one of said two knives (7,8), with said two hooks being connected to each other by a cord (22); in that each lifter element (1), (2) comprises a top lifter roller (1"), (2") and the bottom lifter roller (1'), (2'); and wherein the cord (22) is passed under the top lifter roller (1"), (2"), while the lifter cord (10) is passed over the bottom lifter roller (1'), (2').

9. Lifter device for a jacquard machine according to claim 1, characterized in that each lifter element (1), (2) is suspended from one hook (23), (24), said one hook being adapted to be selected for retention at one of two different heights.

* * * * *